US005341748A

United States Patent [19]

Liu

[11] Patent Number: 5,341,748

[45] Date of Patent: Aug. 30, 1994

[54] STACKABLE PALLET

[76] Inventor: Cheng-Chia Liu, No.10. Sung-chiang N. Rd., Chung-Li City, Taiwan

[21] Appl. No.: 92,887

[22] Filed: Jul. 19, 1993

[51] Int. Cl.[5] ..... B65D 19/00

[52] U.S. Cl. ..... 108/53.3

[58] Field of Search ..... 108/51.1, 53.1, 53.3, 108/53.5

[56] References Cited

U.S. PATENT DOCUMENTS

| | | | |
|---|---|---|---|
| 2,973,931 | 3/1961 | Brown | 108/53.3 |
| 3,641,949 | 2/1972 | Monk | 108/53.3 |
| 3,696,761 | 10/1972 | Brown | 108/53.3 |
| 4,000,704 | 1/1977 | Griffin, Jr. | 108/53.3 X |
| 4,279,204 | 7/1981 | Propst | 108/53.3 |

*Primary Examiner*—Jose V. Chen

*Attorney, Agent, or Firm*—Bacon & Thomas

[57] ABSTRACT

A plastic pallet having a plurality of downwardly extending hollow conical struts, each of which is provided with an asymmetrical concavity, with all concavities facing the same direction, the struts being receivable within corresponding struts of an adjacent pallet whereby, in a first orientation the space between adjacent pallets is decreased for storage purposes, and in a second orientation the space between the stacked pallets is increased for receiving a fork-lift therebetween.

2 Claims, 4 Drawing Sheets

PRIOR ART

STACKABLE PALLET

BACKGROUND OF THE INVENTION

The present invention relates to an improved structure of a pallet, especially a pallet with overlap and direct pile-up function, characterized in that on the lower parts of the oval struts located at the bottom of the pallet at least a ½ cut for each strut is provided and formed into a slot. While mass producing or storing the pallets for a longer period, the pallets can be laid to overlap each other in lots for saving spaces, and when in use the pallets can be turned around 180° and by means of the slots of the struts of the upper layer to build a clearance inside the struts of the bottom layer for the convenience of the fork lifting.

Various pallets have been disclosed for storing and transporting goods. In the past times, pallets are made of wood. Since the wooden ware is not waterproof and easy to break, therefore, plastic pallets made by integral injection method were invented later. However, when the pallets are not in use, they are usually stored in a factory and produce the following problems due to ineffective lay to overlap : (1) conventional pallets have no snapping elements for overlapping storage, slippage problem wastes the operation time and it will be impossible to store the pallets in good order; (2) due to the slippage of the overlapping surfaces, the pallets will be inclined and fall down after a certain stacked height therefore, the conventional pallets can not make effective optimal pile-up storage, in order words, more piles are required. This not only waste the warehouse spaces, but also the pallets to be overlapped in accumulation (i.e. two pallets to be overlapped together, its total height is the height of two pallets), will form a great height and occupy a large space; (3) for pallet manufacturers, during transport of the pallets, transportation time is wasted since they are slippery and easy to dropped, waste much storage height, and more transportation times are required. Thus, transportation costs will be increased and caused problems for the transporter; (4) empty pallets stored in a factory sometimes must be handled manually, since the surface and weight of pallets are large and heavy, it will easily get worn during pulling transportation and if they are carried, at least 2 people are required to avoid any surface damage, therefore wasting manpower. Recently, the insert type pallet with improvement to solve the afore-said disadvantages have been disclosed. (Referring to FIG. 5) The main feature of the pallet is that flange pieces are provided at each corner angle of its bottom and a plurality of conic struts protrude from the bottom of the pallet, each conic hole is provided on the pallet front surface of the symmetric struts and has the same conicity as the strut but with a conic bore larger than the outside diameter of the strut, so that when the pallet is not in use and is laid to overlap, it can be inserted into the lower pallet by the symmetrical conic holes. Although such structure enables the overlapping surfaces to have antislippage effect, clearances have to be provided between overlapping surfaces receiving for the supporting leg of a fork-lift to lift conveniently. Therefore, flange pieces are essential elements which however also increase the overlapping height and decrease the amount of overlapping pallet so that the storage spaces would be wasted. In view of this, the inventor of the present invention has endeavored for many years to improve the strut by changing its shape to oval so that the pallet can be overlapped and piled up with no flange pieces on the bottom.

SUMMARY OF THE INVENTION

It is therefore the main object of the present invention to provide a pallet with an overlap and stacking function. While mass producing or long time storage, said pallets can be laid to overlap each other in lots, so certain pallets can form a unit. The struts in every bottom angle of every pallet can be inserted into the symmetrical conic holes completely so that pallets can be contacted tightly which would reduce the stacked height and increase the overlapping pallets for saving storage spaces, and when in use the pallets can be turned around 180° and by means of the slots of the struts of the upper layer to build a clearance inside the struts of the bottom layer for the convenience of fork lifting.

DETAILED DESCRIPTION OF THE PREFERRED EMBODIMENTS

Figure 1:
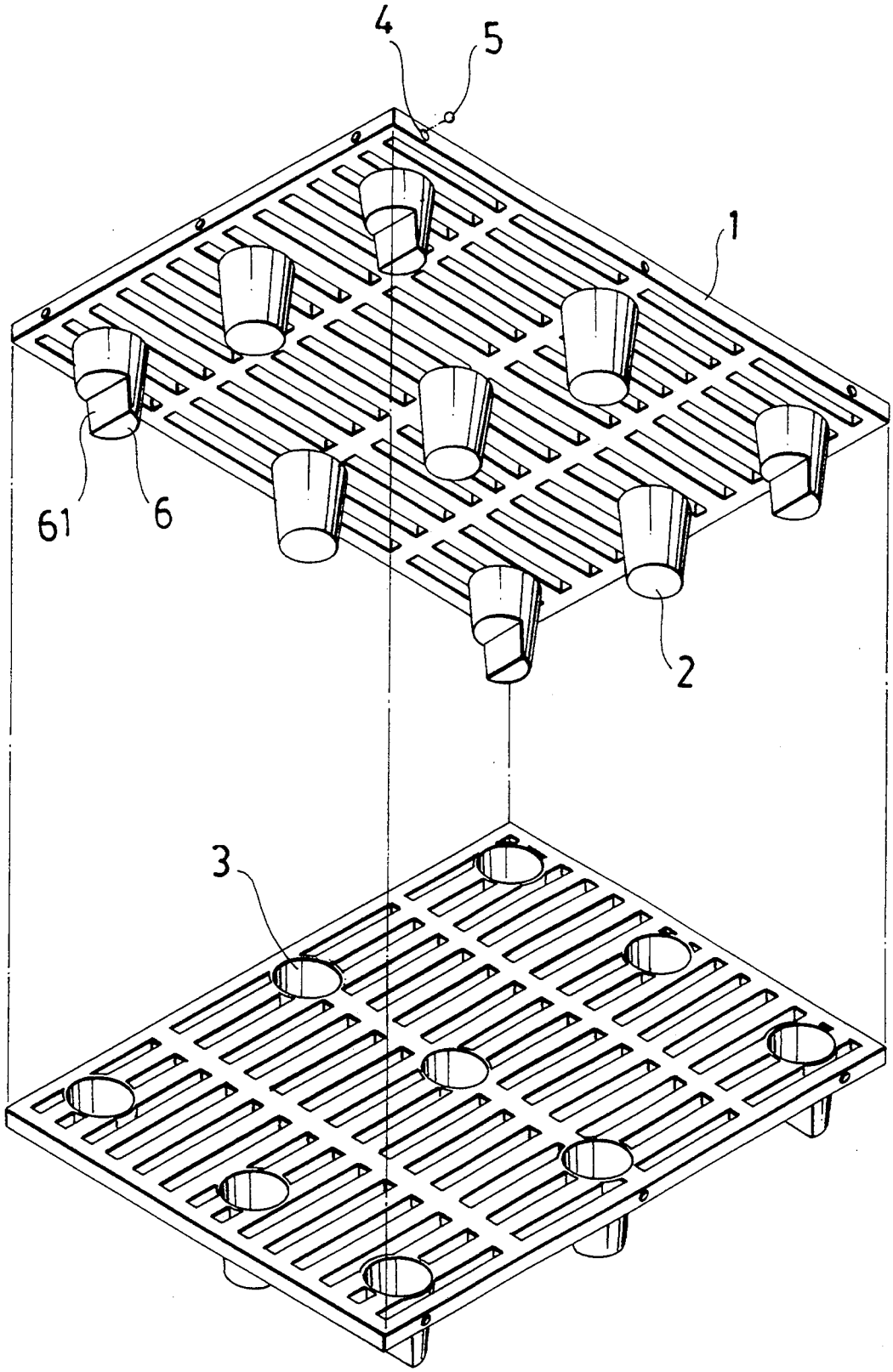
FIG. 1 is a schematic drawing showing the structure of the present invention.
Figure 2:
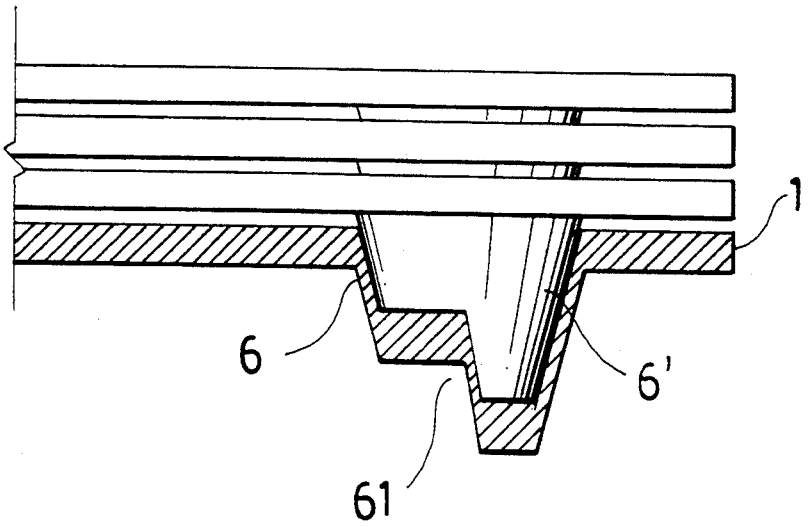
FIG. 2 is a schematic drawing showing the pallet of the present invention in storage for a long period.

Referring to FIG. 1, therein illustrated is a plastic pallet with overlap and direct stacking function. The pallet body 1 has several oval conic struts 2 protruded from the bottom, the same number of oval conic holes 3 on the top for inserting said oval conic struts 2. Each conic hole 3 has the same conicity as the strut 2 and the conic hole 3 is larger than the outside diameter of the strut 2. Several slots 4 are provided around main body 1 of the pallet, each strut 2 has a slot 4 installed in the bottom wherein a carrying ball 5 has its socket base connected with a shaped snap axle, said snap axle has several symmetrical open slots provided around, said carrying ball 5 can be inserted into slot 4 because of the flexibility of said open slot. (The aforesaid description is a usual handicraft which is not within the scope of the invention).

Figure 3:
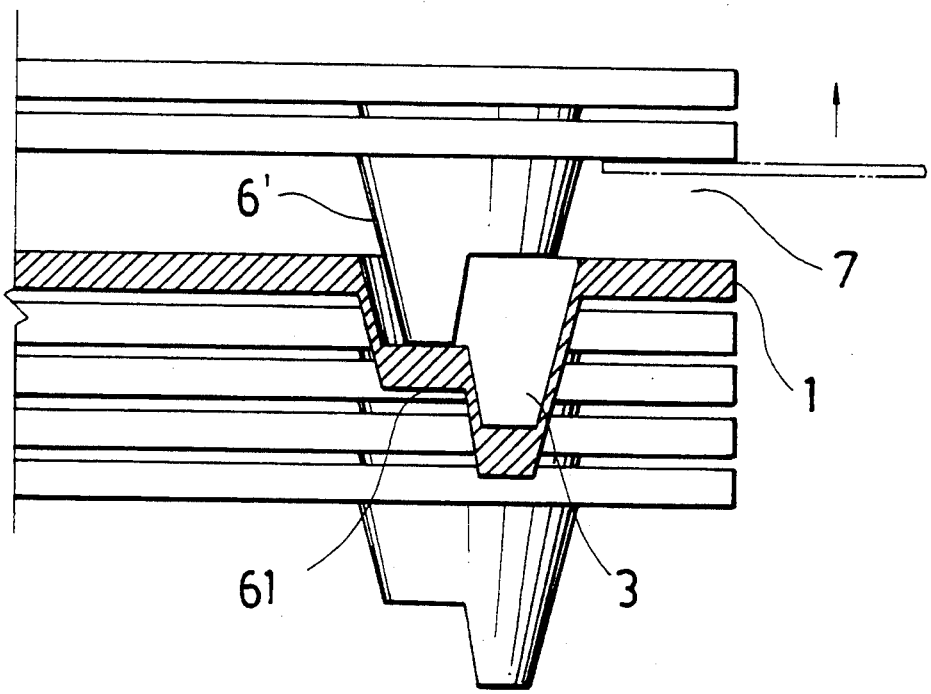
FIG. 3 is a schematic drawing showing the pallet of the present invention in use frequently.
Figure 4:
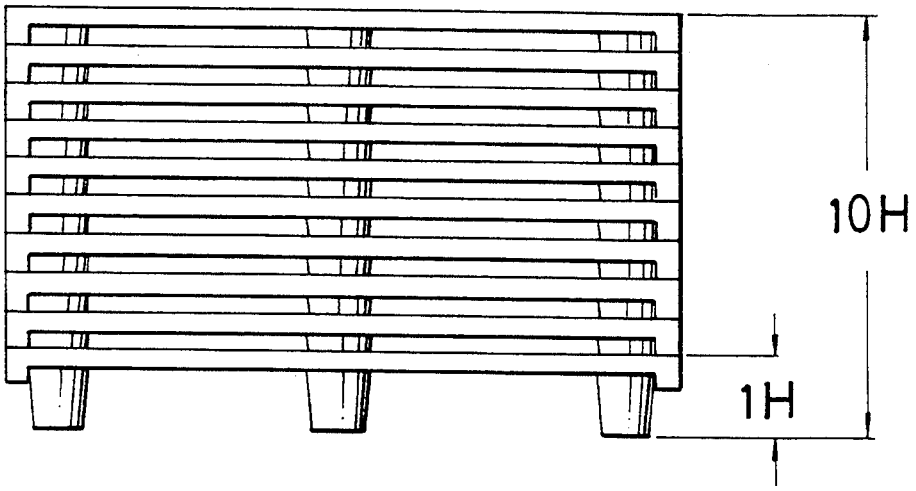
FIG. 4 is an illustration showing a comparison of the overlapping amount of the present pallet and the prior art pallet.
Figure 4:
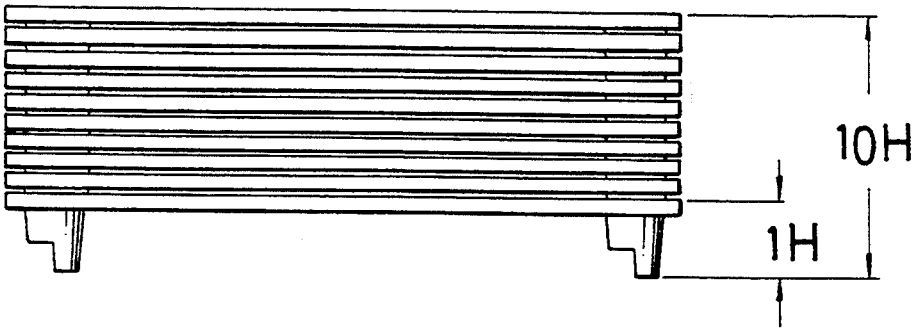
Figure 5:
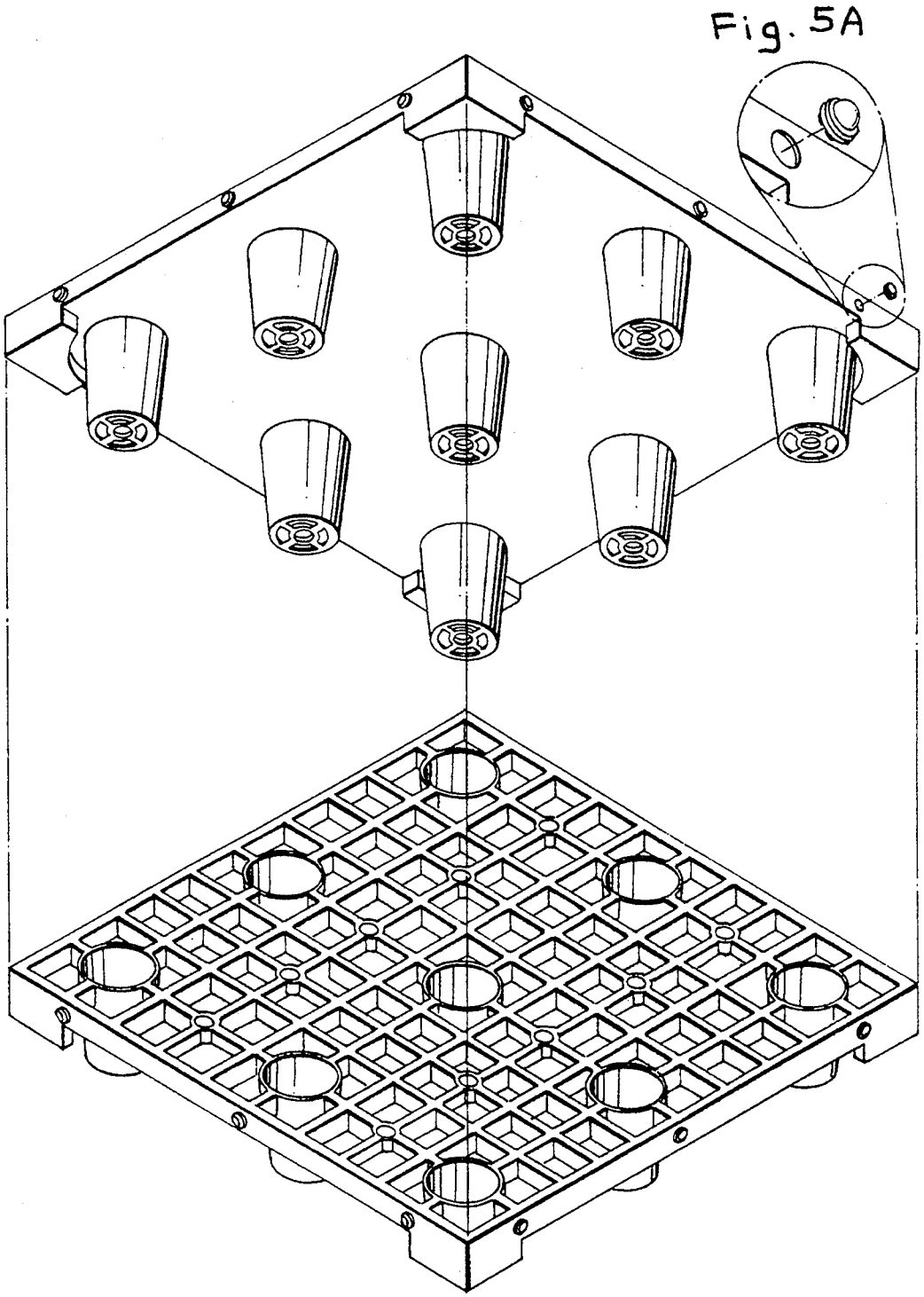
PRIOR ART Fig. 5
FIG. 5 is a schematic drawing shows the structure of the prior art pallet.

The present invention is characterized in the ½ indentation of each oval conic strut 6 in the corner angles of the bottom of main body 1 which forms the asymmetrical concavities 61 facing in the same direction. Each concavity is defined by offset inner and outer horizontal walls. When pallets are not in use, they can be stored in lots by inserting the struts 6 in the corner angles of the bottom of the pallet into the symmetrical conic holes 3 in the surface of the lower layer pallet completely. For contacting pallets tightly, just turn around the bottom pallet 180° so that the outer horizontal walls of the upper struts 6 can be supported by the inner horizontal walls of the lower struts 6 and form a clearance 7 for the convenience of fork lifting. (See FIG. 3) Since every lot of pallets is contacted with each other tightly, there is no clearance for wasting spaces. The height of overlapping would be optimally high in the limited spaces. Provided the height of a pallet is about 150 cm wherein main body 1 is about 50 cm and the strut 2,6 are about 100 cm, a pile of ten pallets would be $150+(50\times 9)=600$ in height; provided the prior art pallet is also 150 cm in height wherein main body is about 50 cm and the flange piece is 30 cm, a pile of ten pallets would be $(50+30)\times 9+150=870$ cm which means that the present invention could save almost one fifth of total height (See FIG. 4). Comparing the total height of the older pallet $(150\times 10)=1500$ mm, the present invention could even save 60% of total height for storage. In other words, the same number of pallets can be stored in two fifth of the spaces of the original factory so that the spaces can be saved effectively, and the transportation time and the cost of manpower can be reduced, too. When pallets are in use frequently, the pallets in even number can be turned around 180° so as to insert the struts 6' in the corner angles of the bottom of main body 1, into the symmetrical conic holes 3 in the surface of the main body 1 of the pallets in odd number, the bottom edges of the upper struts 6 can be supported by the upper edges of the concavities 61 of the bottom struts 6 so that a clearance 7 would be formed between the adjacent main bodies for the convenience of fork lifting.

What is claimed is:

1. A pallet of the type including a support platform and a plurality of hollow, conical-shaped struts extending downwardly from the platform for nesting engagement within corresponding struts of an adjacent pallet to permit stacking of the pallets, the improvement comprising:

a) each conical strut including a lower portion provided with an asymmetrical concavity which extends inwardly from one side of the lower portion approximately one-half of the width thereof, each concavity being partially defined by an inner horizontal wall and an outer horizontal wall, and all concavities facing in the same direction to permit nesting of two adjacent pallets in either of first and second nesting orientations; wherein b) in the first nesting orientation, the inner and outer horizontal walls of the adjacent pallets are disposed in corresponding respective engagement with each other for decreasing the spacing between the support platforms of the nested pallets; and c) in the second nesting orientation, the outer horizontal walls of one pallet are disposed in engagement with the inner horizontal walls of the other pallet for increasing the spacing between the support platforms of the nested pallets.

2. The pallet of claim 1 wherein the pallet is formed of plastic.

* * * * *